US007758483B2

(12) United States Patent
Boss

(10) Patent No.: US 7,758,483 B2
(45) Date of Patent: Jul. 20, 2010

(54) METHOD AND DEVICE FOR PRODUCING FOLDED PRINTED PRODUCTS

(75) Inventor: Heinz Boss, Strengelbach (CH)

(73) Assignee: Grapha-Holding AG, Hergiswil (CH)

( * ) Notice: Subject to any disclaimer, the term of this patent is extended or adjusted under 35 U.S.C. 154(b) by 1950 days.

(21) Appl. No.: 09/970,480

(22) Filed: Oct. 4, 2001

(65) Prior Publication Data

US 2002/0042333 A1 Apr. 11, 2002

(30) Foreign Application Priority Data

Oct. 10, 2000 (EP) ..... 00810936

(51) Int. Cl.
*B31B 1/88* (2006.01)
*B31B 1/92* (2006.01)

(52) U.S. Cl. ..... 493/187

(58) Field of Classification Search ..... 493/23, 493/28, 187, 243, 244, 249, 320, 357, 421
See application file for complete search history.

(56) References Cited

U.S. PATENT DOCUMENTS 3,977,665 A 8/1976 Bowman et al.
4,799,661 A 1/1989 Nail

FOREIGN PATENT DOCUMENTS

| | | |
|---|---|---|
| DE | 3608055 | 10/1996 |
| EP | 0861734 | 9/1998 |
| EP | 0869092 | 10/1998 |
| EP | 0876977 | 11/1998 |
| EP | 0739838 | 9/1999 |
| EP | 0992365 | 4/2000 |
| EP | 1005984 | 6/2000 |
| EP | 1 288 297 | 3/2003 |
| WO | 01 88131 | 11/2001 |

OTHER PUBLICATIONS

P. Berger:Deutscher Drucker, DE, Ostfildern, BD. 34, No. 35, Sep. 17, 2998, PPS W45, W48 XP000783487.
Van Der Voort Robbert et al: Journal of Biological Chemistry, BD. 274, No. 10, Mar. 5, 1999, pp. 6499-6506, XP002265660.
Recio Juan et al: Cancer Research, BD. 63, No. 7, Apr. 1, 2003, pp. 1576-1582, XP002265661.
Seiter S et al: Journal of Experimental Medicine, Tokyo, JP, BD. 177, No. 2, Feb. 1, 1993, pp. 443-455, XP000471653.
Shimabukuro Koji et al: Gynecologic Oncology, BD. 83, No. 2, Nov. 2001, pp. 205-215, XP002265662.

*Primary Examiner*—Rinaldi I. Rada
*Assistant Examiner*—John Paradiso
(74) *Attorney, Agent, or Firm*—Friedrich Kueffner

(57) ABSTRACT

In a method for producing folded printed products a paper web is printed by at least one digital printing machine and the paper web is then processed by a sequence of processing steps, wherein full size sheets or web sections having at least four printed pages for a printed product with a multiple of four printed pages are cut from the paper web. The full size sheets or web sections are then folded to a folded state, respectively. The full size sheets or web sections are collected in the folded state and subsequently stitched. A buffer is formed of the full size sheets or the web sections during the sequence of the processing steps and the full size sheets or the web sections coming from the buffer are individualized to decouple the digital printing machine from at least some of the processing steps.

30 Claims, 8 Drawing Sheets

METHOD AND DEVICE FOR PRODUCING FOLDED PRINTED PRODUCTS

BACKGROUND OF THE INVENTION

1. Field of the Invention

The invention relates to a method and a device for producing folded printed products such as, for example, newspapers or brochures, wherein by means of at least one digital printing machine a paper web is sequentially printed, respectively, and, subsequently, this paper web is cut or further processed into full-size sheets or into web sections, each divided into at least four pages, for printed products with a multiple of four pages, wherein the full-size sheets or web sections are folded, the folded full-size sheets or web sections are collected, and the collected, folded full-size sheets or web sections are stitched.

2. Description of the Related Art

Devices of the aforementioned kind are known, for example, from European patent application EP 1 005 984 A1. In this method, the printed products are received as a printed paper web from an electronic printer, for example, a laser printer, and are cut by means of a cutting device to individual full-size sheets. The sheets are then provided in the transport direction with one or two scoring lines and are then folded so as to form a fold. The folded printed products are then collected to form a saddle-shaped stack which is stitched. In order for the spine of the printed product to be as narrow as possible, the spine is pressed.

European patent application EP 0 992 365 A1 discloses a method wherein the printed products are also individually folded before being collected. The folded printed products are stacked, stitched, and cut.

European patent document EP 0 869 092 of the applicant describes a method for producing printed products wherein the webs of paper are printed according to a preselected page sequence and are cut to individual sheets. The cut sheets are rotated with respect to their position by 90° and then fed for further processing to feeders 11.

The sheet-wise folding of the sheets before collecting them has a decisive advantage in that a good folding quality is achieved and even multi-page brochures with a comparatively narrow spine can be produced. In the described methods and the corresponding processing arrangements or device there is the difficulty that even comparatively short disruptions in the processing sequence, for example, during stitching, result in disruptions and negative feedback in regard to the printing machine.

SUMMARY OF THE INVENTION

It is an object of the present invention to provide a method and a device of the aforementioned kind with which a substantially increased output can be achieved and which, in spite of this, provide a good folding quality.

In accordance with the present invention, this is achieved in regard to the method of the invention in that the digital printing machine is decoupled from the further processing sequence of the full-size sheets or web sections by buffering the full size sheets or folded web sections and individualizing the full-size sheets or the folded web sections downstream of the buffer in the direction of further processing.

In accordance with the present invention, this is achieved in regard to the device of the invention in that the device for producing the printed products by means of a digital printing machine comprises a cutting machine for cutting the web to a plurality of full-size sheets or web sections, a transport device, at least one folding device, means for collecting the folded full-size sheets or web sections and means for stitching the collected full-size sheets or web sections, means for forming a buffer before individualizing the full-size sheets or the folded web sections by a feeder.

According to the method of the invention, the digital printing machine is decoupled from the further processing sequence of the full size sheets or the folded web sections before individualizing the full size sheets or web sections. Comparatively short disruptions in the further processing sequence, for example, during stitching or cutting, can be eliminated without disruption of the printing process of the digital printing machine. The full-size sheets or web sections which are collected during this disruption are received in a buffer, which can be a stack, a retaining stretch or a coil. Once the disruption is eliminated, the buffer can be reduced by increasing the output in the further processing sequence.

According to a further development of the invention the buffer is provided in the form of a stack. Such a stack can be further processed with especially high output by means of a folding feeder. The feeder takes the full-size sheets or folded web sections from the bottom side of the stack and individualizes them.

An even higher output is possible according to a further embodiment of the invention when the full-size sheets are distributed and fed to at least two buffers. Preferably, this distribution is realized by means of at least one switch. With this distribution of the full-size sheets the output can be doubled.

A substantially higher output is also possible in that, according to a further embodiment of the invention, sections of the printed web are folded before forming the buffer. According to a further embodiment of the invention, folding is realized advantageously by means of a pocket folder or buckle folding machine.

The processing is particularly efficient when according to a further embodiment of the invention the full-size sheets or the web sections are collected on a knife after folding. The knife according to an advantageous embodiment of the invention is arranged above a continuously circulating collecting chain of a gatherer-stitcher. When all full-size sheets or web sections are collected on the knife, it is retracted, preferably in the moving direction of the collecting chain, and the collected printed products are dropped onto the collecting chain. On the moving collecting chain the printed products are fed by means of followers, for example, to a stitching machine and subsequently to a cutting machine.

DESCRIPTION OF THE PREFERRED EMBODIMENTS

Figure 1:
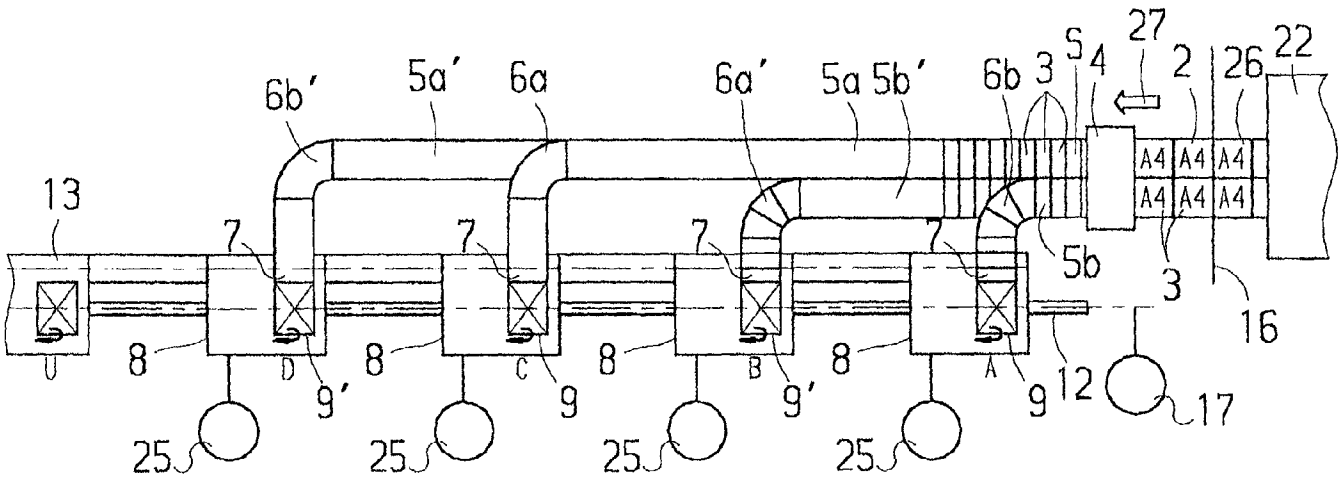
FIG. 1 shows schematically a plan view onto a first embodiment of the device according to the invention.
Figure 2:
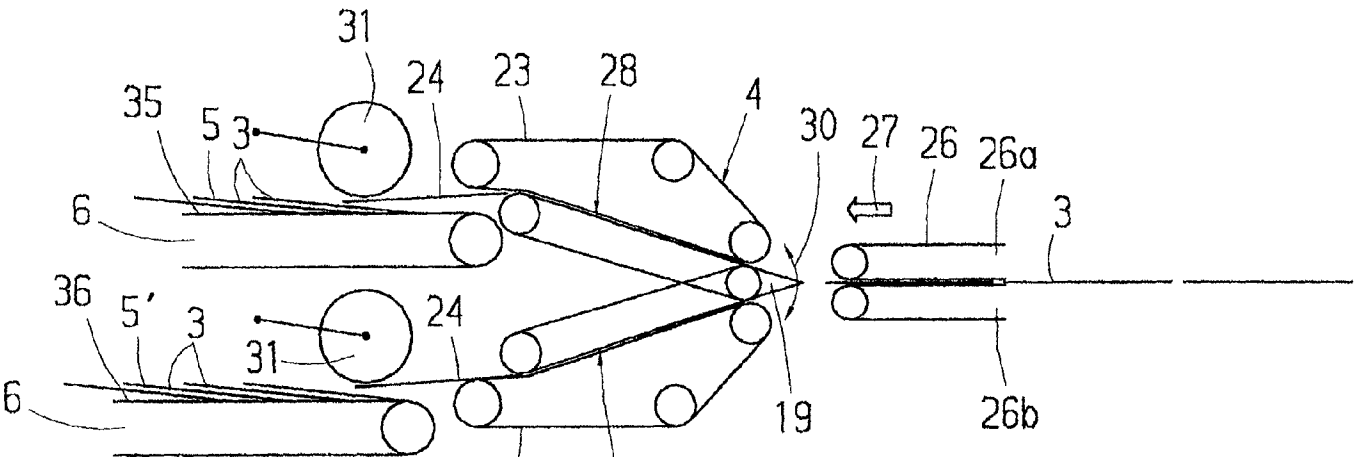
FIG. 2 shows schematically a side view of a part of the device according to FIG. 1.

FIG. 1 shows schematically a printing machine 22, in particular, a digital printing machine, which prints a paper web 2 on one or both sides such that by means of the cutting device 16 this paper web 2 can be cut to full-size sheets 3 of A4 size. As can be seen in the drawing, in the transport direction of arrow 27 two such full-size sheets 3 are moved adjacent to one another. The transport of the individualized full-size sheets 3 according to FIG. 2 is realized by a transport device 26 which has an upper run 26*a* and a lower run 26*b*. The paper web 2 is cut by means of the cutting device 16 transversely and longitudinally.

The cut full-size sheets 3 are than moved by means of the transport device 26 to a switch 4 which comprises a tongue or flap 19 which can be pivoted upwardly and downwardly in the direction of double arrow 30. In FIG. 2 the flap 19 is shown in its middle position. When the flap or tongue 19 is pivoted downwardly, the cut full-size sheets 3 are guided in the upward direction to a transport device 28. When the tongue or flap 19 is pivoted upwardly, the full-size sheets 3 are supplied to a transport device 29 which, according to FIG. 2, extends at a slant downwardly. Both transport devices 28 and 29 form at their forward end a transfer station 23 by which a so-called cascade 24 is formed with which the printed products 3 are guided downwardly to a belt 6 which is running slower. With the assistance of a roller 31 an imbricated flow 5 is formed. As illustrated in FIG. 2, on an upper plane 35 two imbricated flows 5 are formed adjacently to one another and on the lower plane 36 there are also two imbricated flows 5' formed that run adjacently and parallel to one another. The formation of the imbricated flows 5 and 5' is not imperative but has the essential advantage that the transport speed can be lowered and a calming of the material transport can be achieved.

The two imbricated flows 5*a* and 5*b* of the upper plane 35 are deflected at a spacing to one another at bends 6*a* and 6*b* by 90° and are supplied to a stacking device 9 of a folding feeder 8. The two imbricated flows 5*a'* and 5*b'* of the lower plane 36 are also supplied via bends 6*a'* and 6*b'* to a stack 9' of a feeder 8. The feeder 8 has according to FIG. 3, in a manner known in the art, a gripping drum 10 and suction devices (not illustrated) or other gripping means with which the full-size sheets 3 are removed individually from the bottom side of the stacking device 9 and then folded. The control action during removal and individualization of the full-size sheets 3 is carried out preferably by a read head, not illustrated, which at the beginning and at the end of the printed product 1 to be formed reads or recognizes, for example, a printed control mark or a bar code. On the gripping drum 10 the full-size sheets 3 can be scored for folding in a manner well known in the art.

The folded full-size sheets 3 of a printed product are then collected on a knife 11. The number of the collected full-size sheets 3 can be different for each printed product. The sequence of the collected full-size sheets 3 on a respective knife 11 corresponds to the page sequence of the printed product. When all of the folded full-size sheets 3 of a printed product have been collected on a knife 11, it is retracted by means of a pneumatic pressure cylinder 11*a* in the transport direction according to arrow 31 such that the collected and folded full-size sheets 3 drop onto a continuously circulating collecting chain 12 and are entrained in a manner known in the art by followers 32 to be transported in the direction of arrow 31. Dropping of the full-size sheets 3 onto the collecting chain 12 is carried out synchronously and is triggered by a control unit, not illustrated, so that the divided sections of the collecting chain 12 can be filled sequentially as completely as possible.

Figure 3:
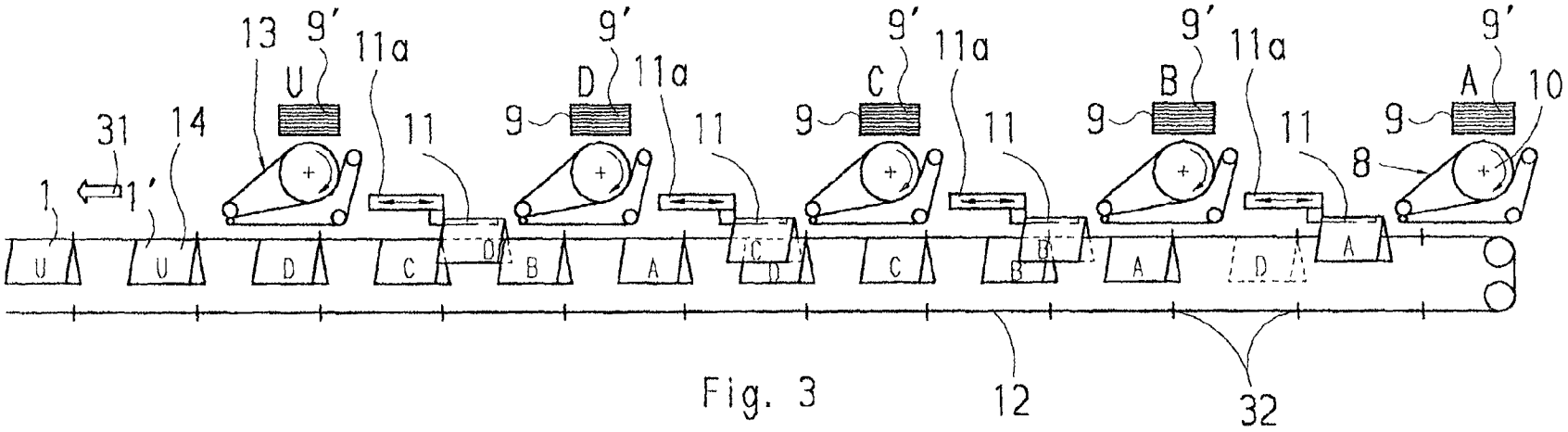
FIG. 3 shows schematically a side view of the device according to FIG. 1.

FIG. 3 shows the collecting chain 12 with printed products 37, 38, 39 and 40 dropped onto it. These printed products are not yet provided with a cover 14 which is supplied to the dropped printed products by means of a further cover folder feeder 13. The cover 14 is therefore added additionally and, subsequently, the printed products are completed and can be bound, for example, by stitching, by means of a device not shown. FIG. 3 shows all the way to the left a finished printed product 1 which must only be bound still. The subsequent printed product 1' can be an identical or a different printed product. The printed product 1 is, in particular, a brochure which can have, for example, up to 200 pages.

The drive of the folding feeder 8 is realized preferably by separately controlled electric motors 25. The drive of the collecting chain 12 and, for example, of a stitching machine (e.g., a gatherer stitcher) 15 or a cutting machine is realized by a common further drive motor 17.

Figure 6:
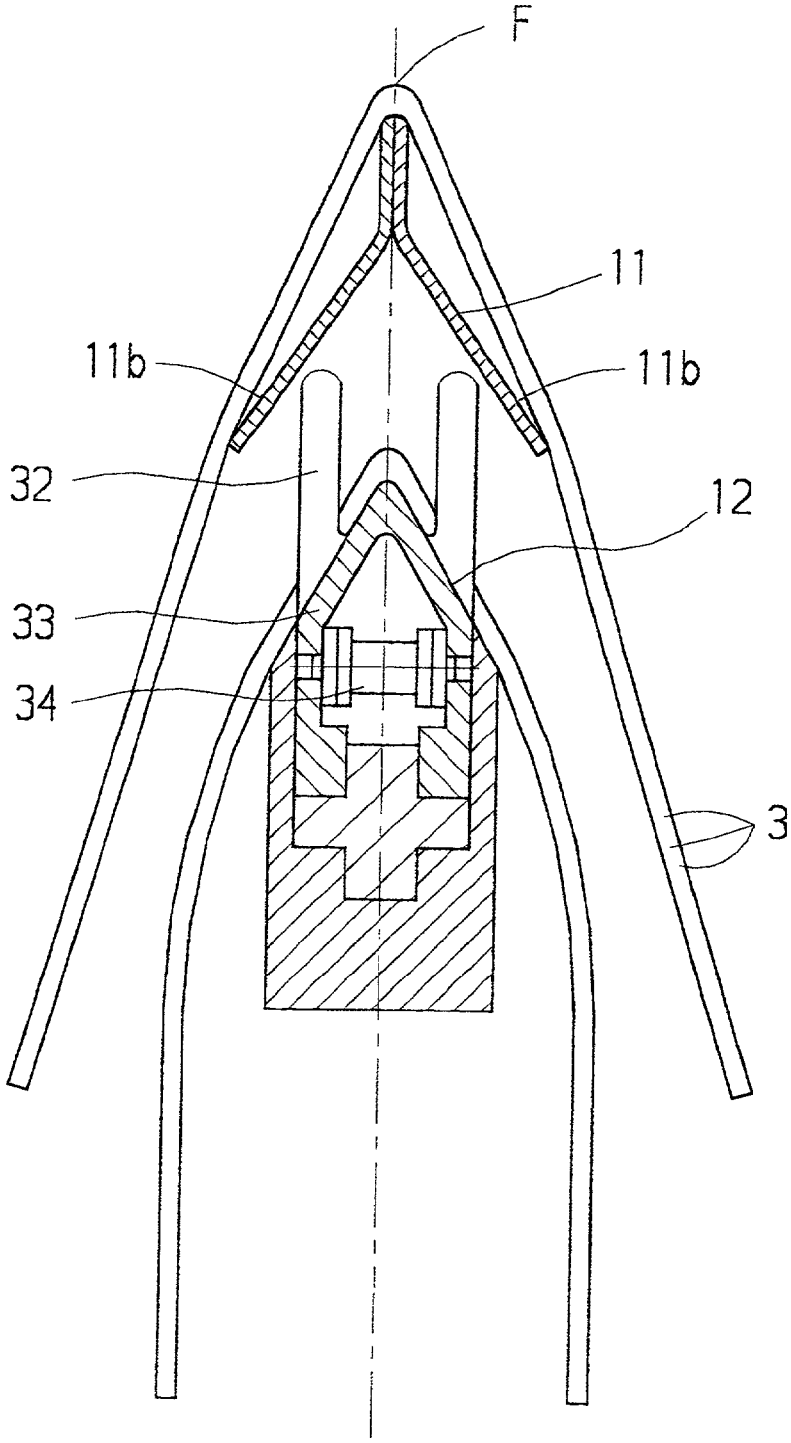
FIG. 6 is a schematic section of a knife and a collecting chain.

As illustrated in FIG. 6, the collected full-size sheets 3 are positioned in a saddle-like fashion on a knife 11 which is triangular in cross-section, wherein the fold F is located at the top and extends in the transport direction according to arrow 31. Arms 11*b* projecting at a steep angle laterally outwardly secure the collected and folded full-size sheets 3 in a spread-apart position. The collecting chain 12 extends parallel to the knife 11 and below it. It has chain members 34 on which saddle-like supports 33 are fastened and moveably guided on a rail (shown at 12 in FIG. 6) of the collecting chain 12. On some of the supports 33 an upwardly projecting follower 32 is fastened. When the knife 11, as mentioned above, is retracted, the collected full-size sheets 3 drop onto the collecting chain 12 and are entrained by the followers 32. The drop is carried out, of course, synchronously to the movement of the collecting chain 12. When retracting the knife 11, the collected full-size sheets 3 are accelerated in the movement direction of the collecting chain 12; this ensures a gentle entrainment by the followers 32. After dropping, the knife 11 is then again moved by the pressure cylinder 11*a* into the initial position and is now ready for receiving further full-size sheets 3.

Figure 4:
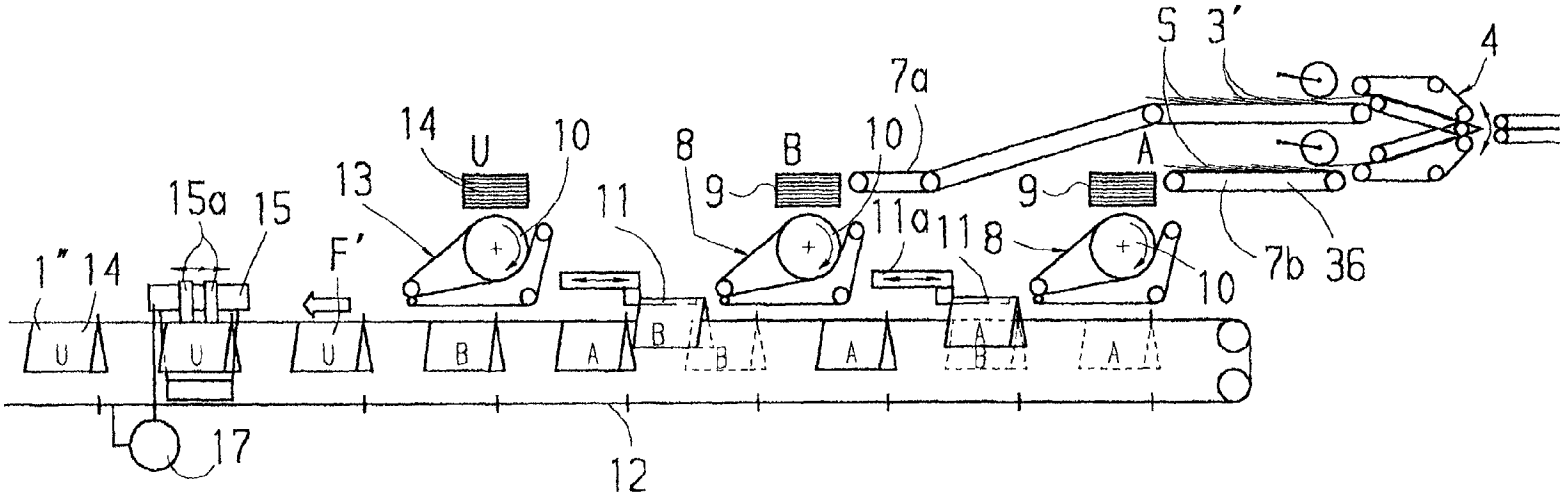
FIG. 4 is a side view of a second embodiment of the device according to the invention.
Figure 5:
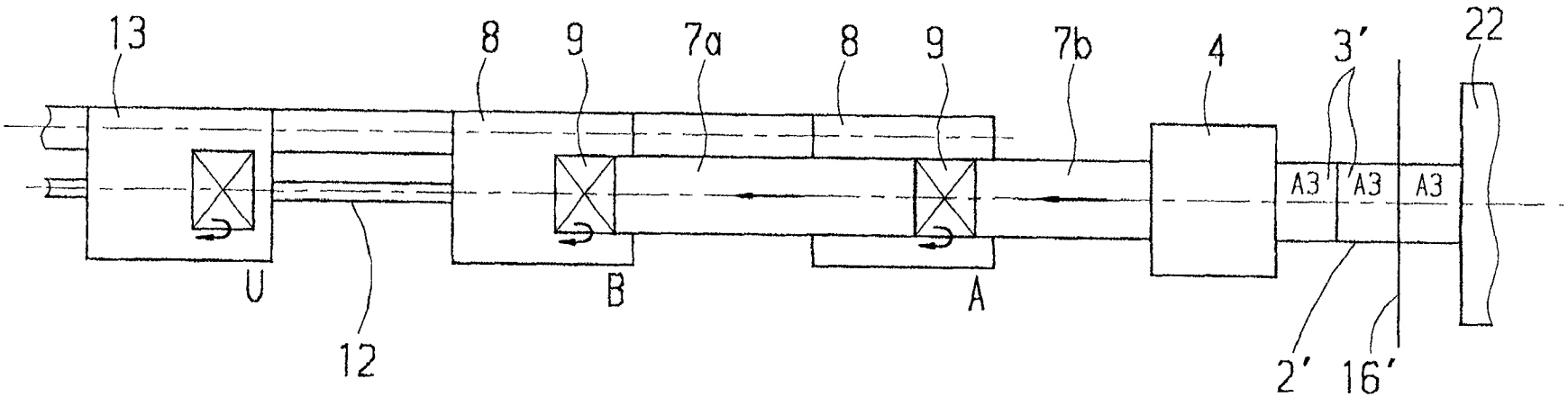
FIG. 5 is a schematic plan view of the device according to FIG. 4.

In the arrangement according to FIGS. 4 and 5, a sequentially printed paper web 2' is processed which is cut by means of the cutting device 16' only transversely to the transport direction to full-size sheets 3'. These full-size sheets 3', for example, have the size or format A3 which is aligned according to FIG. 5 transversely to the transport direction. The cut full-size sheets 3' are transported via a switch 4, as mentioned above, to an upper plane 35 or to a lower plane 36 and are transported farther in these planes as an imbricated flow, respectively. The imbricated flow of the upper plane 35 is transported by means of a transport device 7*a* to the stacking device 9 of a folding feeder 8, and the imbricated flow of the lower plane is horizontally transported with a shorter transport device 7*b* to the stacking device 9 of a further folding feeder 8. As can be seen in the drawing, the transport device 7*a* extends from the upper plane 35 at a slant downwardly to the level of the lower plane 36. The full-size sheets 3' of the web 2' are thus distributed onto two folding feeders 8. Before the full-size sheets 3' are folded in the folding feeders 8, they are stacked, as mentioned above, in the stacking devices 9. This stacking of full-size sheets 3' in the stacking devices 9 has the essential advantage that the material flow is decoupled by the stacks thus formed and that the stacking devices 9 thus provide a buffer. In the stacking devices 9 it is thus possible, for example, to stack for a short period of time more than the regular full-size sheets 3'. Also, in the case of a delay caused by the transport devices 7*a* and 7*b*, the folding feeders 8 can still continue to operate with the supply of full-size sheets 3' in the stacking devices 9. Buffering devices are disclosed, inter alia, in European patent application EP-A-0 876 977, European patent application EP-A-0 739 838, and German patent application DE-A-36 08 055.

The full-size sheets 3' of the size A3 are folded in the folding feeders 8 to the size A4. As mentioned above, the full-size sheets 3' of a printed product 1", with the exception of the cover 14, are also collected on the knife 11. The cover is folded by means of a further folding feeder 13 and added to the collected sheets. When the output of a folding feeder 8 is, for example, 15,000 sheets 3' per hour, it is thus possible to process a total of 30,000 full-size sheets 3' per hour. In the illustrated embodiment, the cut full-size sheets 3' are distributed to two planes 35 and 36. In principle, an embodiment is possible in which more than two planes are provided, for example, four planes are used. Correspondingly, more than two feeders 8 for individualizing and folding can be used.

When the envelope 14 has been added to the full-size sheets 3', they are stitched, for example, by a stitching machine 15 at the fold F. Stitching machines 15 are known to a person skilled in the art and they are provided preferably with floating traveling stitching heads 15*a*. In FIG. 4, a stitched printed product is illustrated at 1". This printed product 1" can then be cut by a cutting device, not illustrated, at its three free sides. These cutting device, the collecting chain 12, and the stitching machine 15 are preferably driven by a common motor 17. The drive of the folding feeders 8 and feeder 13 is realized preferably individually by controlled electric motors 25.

For a short disruption in the processing sequence, for example, at a stitching machine 15, the operation of the printing machine 22 must not be interrupted because the produced full-size sheets 3 can be received in the stacking devices 9 during the disruption. For increasing the stacking capacity, the stacking device 9 can be supplemented or replaced with further buffering means. Once the disturbance has been eliminated, the stacks can be reduced by increasing the output of the folding feeder 8. The speed of the folding feeder 8 can then be increased, for example, to 120% of the speed of the printing machine 22. Accordingly, the collecting chain and the downstream processing devices also operate faster.

Figure 7:
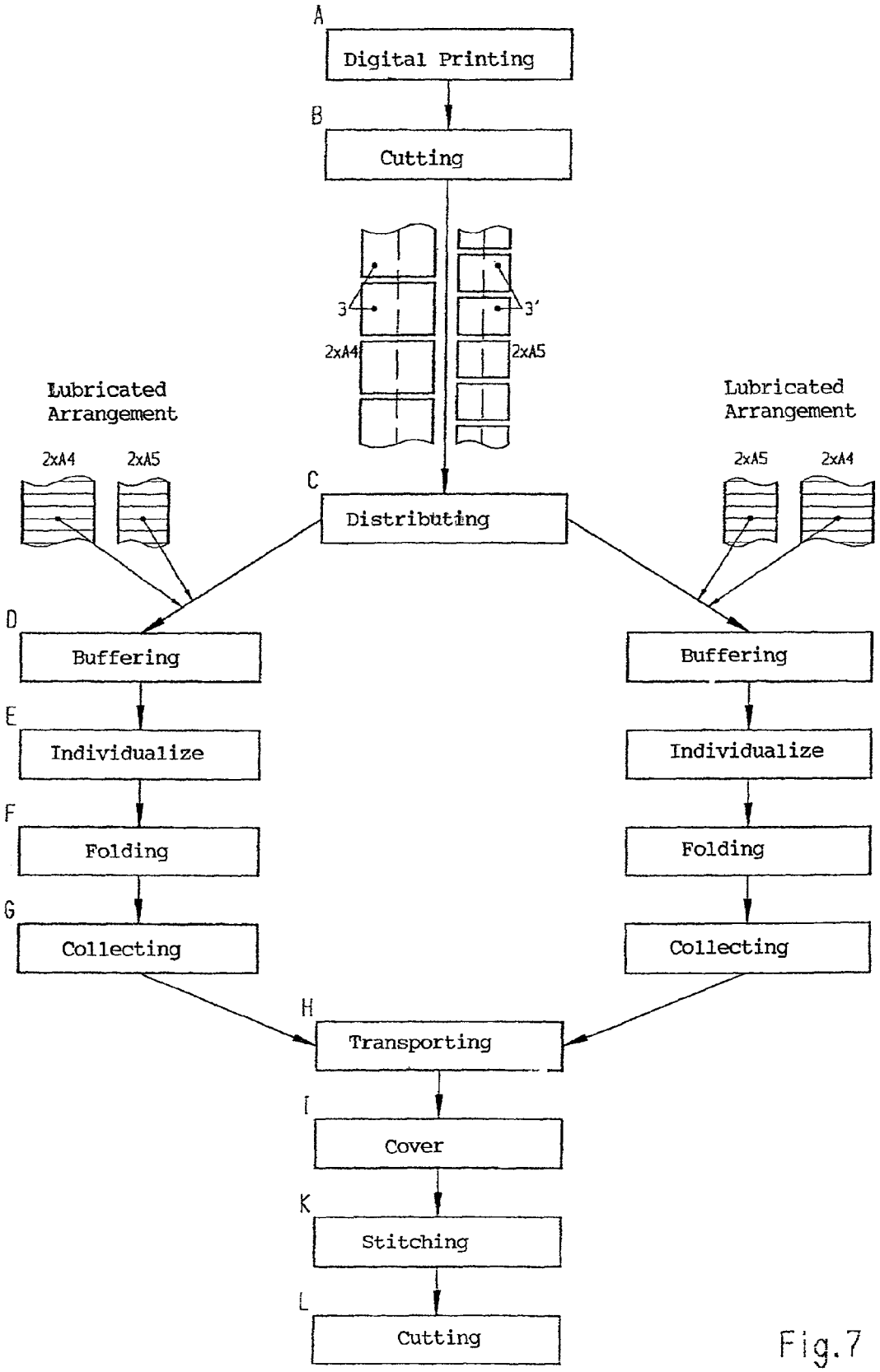
FIG. 7 is a flow chart of the method according to the invention.

The method according to the invention which can be performed with the devices according to FIG. 1 and FIG. 6, is illustrated in the flow chart according to FIG. 7. In the method step A the pages of the brochure are printed sequentially and digitally by means of a digital printing machine 22 in the corresponding sequence. The pages even of a thick brochure can thus be printed successively.

In the method step B the printed paper web 2 is cut to full-size sheets 3 and 3'. The full-size sheets 3 are comprised of two A4 formats and the full-size sheets 3' of two A5 sizes. However, in principle, other divisions are possible also.

The full-size sheets 3 and 3' are distributed to two or more planes by means of the switch 19 in the method step C. The distribution can be realized for individual sheets or in groups of sheets. Downstream of the switch 19 the imbricated arrangement S is realized and transported by means of transport belts to the folding feeders 8.

For decoupling the digital printing machine 22 from the further processing sequence, the incoming imbricated arrangement S is collected on the folding feeders 8 in a stacking device 9 as a stack 9', respectively. This stack 9' forms a buffer, respectively, by which comparatively short disruptions in the further processing sequence can be taken up without any negative feedback on the digital printing machine 22. For longer disruptions, the digital printing machine 22 can be slowed down or stopped in a targeted manner.

In the folding feeders 8 the full-size sheets 3 and 3' are tilted in a way known in the art by non-illustrated suction devices and are individualized by rotating grippers, not illustrated. When a disruption in the processing sequence downstream occurs, the individualization by means of the suction devices can be interrupted and the feeder can be stopped.

In FIG. 7, the buffering action is illustrated at D and the individualization is illustrated at E.

In the method step F the individualized full-size sheets 3 and 3' are folded. For this purpose, the full-size sheets 3 and 3' can be scored, as is known in the art, and subsequently folded by belts, not illustrated, in a continuous process. This provides a very sharp fold F so that even thick brochures of, for example, more than 200 pages can be produced. The drive of the folding feeder 8 is realized preferably independently of the stitching machine 15 via controllable electric motors 25. After folding, the full-size sheets 3 and 3', as described above, are collected on a knife 11. When a complete brochure has been collected on a knife 11, the suction device movement is stopped for a few cycles. During this time, the full-size sheets 3 and 3' can be precisely aligned and can be dropped onto the collecting chain 12 by retracting the knife 11.

After collection, the full-size sheets 3 and 3' are transported on the collecting chain 12. In FIG. 7, this method step is illustrated at H. The collecting chain 12 circulates with a certain speed ratio relative to the number of folding feeders 8 and the number of full-size sheets 3 and 3' to be collected. The synchronous drop of the collected full-size sheets onto the collecting chain 12 is realized by the pneumatic retraction of the corresponding knife 11. This is triggered by a control unit and is realized such that the division of the collecting chain 12 is sequentially completely filled.

The subsequent steps in the further processing sequence relate to the supply of a cover according to method step I, the stitching step K by means of the stitching machine 15, as well as the cutting step L by means of a trimmer, not illustrated, or another cutting machine.

Figure 8:
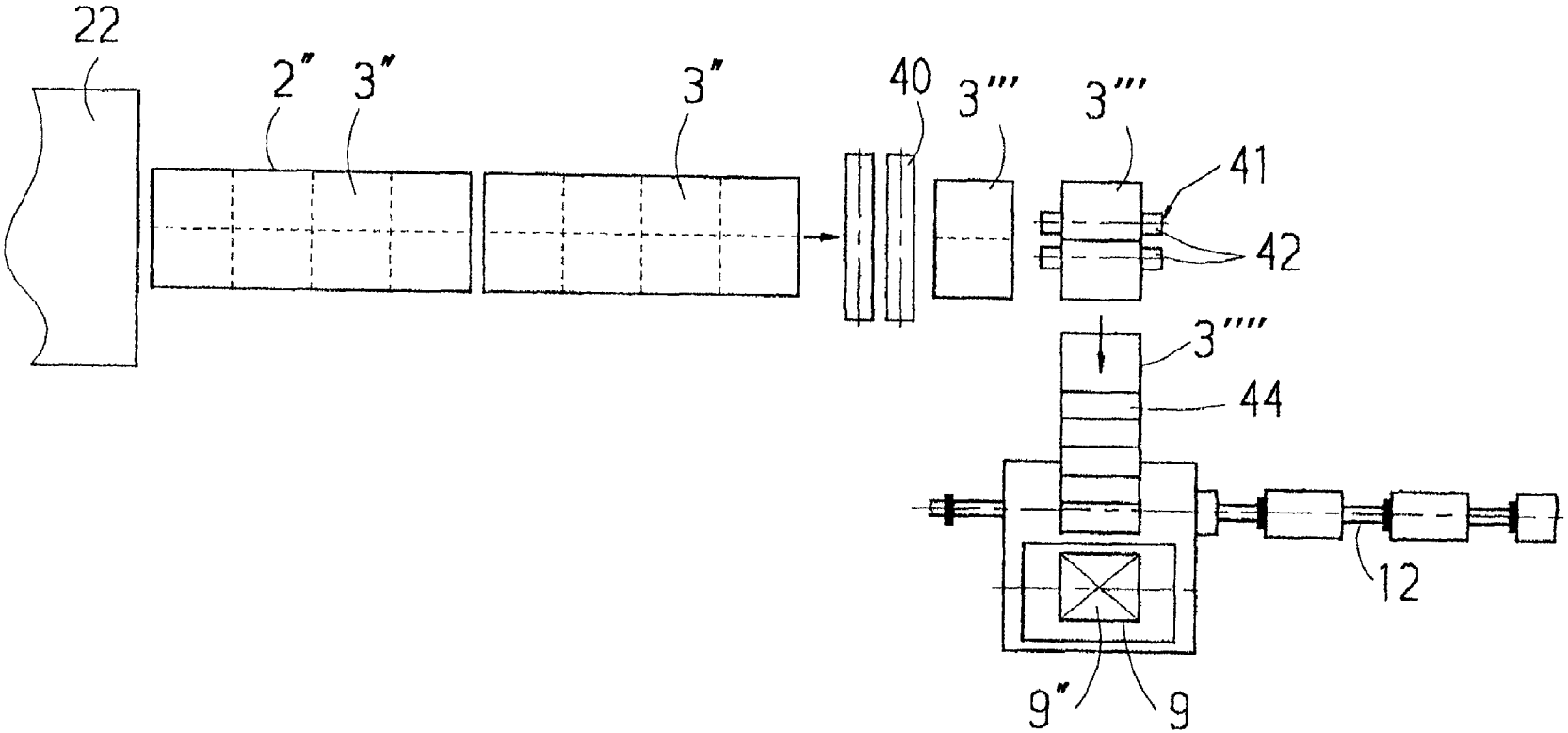
FIG. 8 shows schematically the device according to the invention according to a third embodiment.
Figure 9:
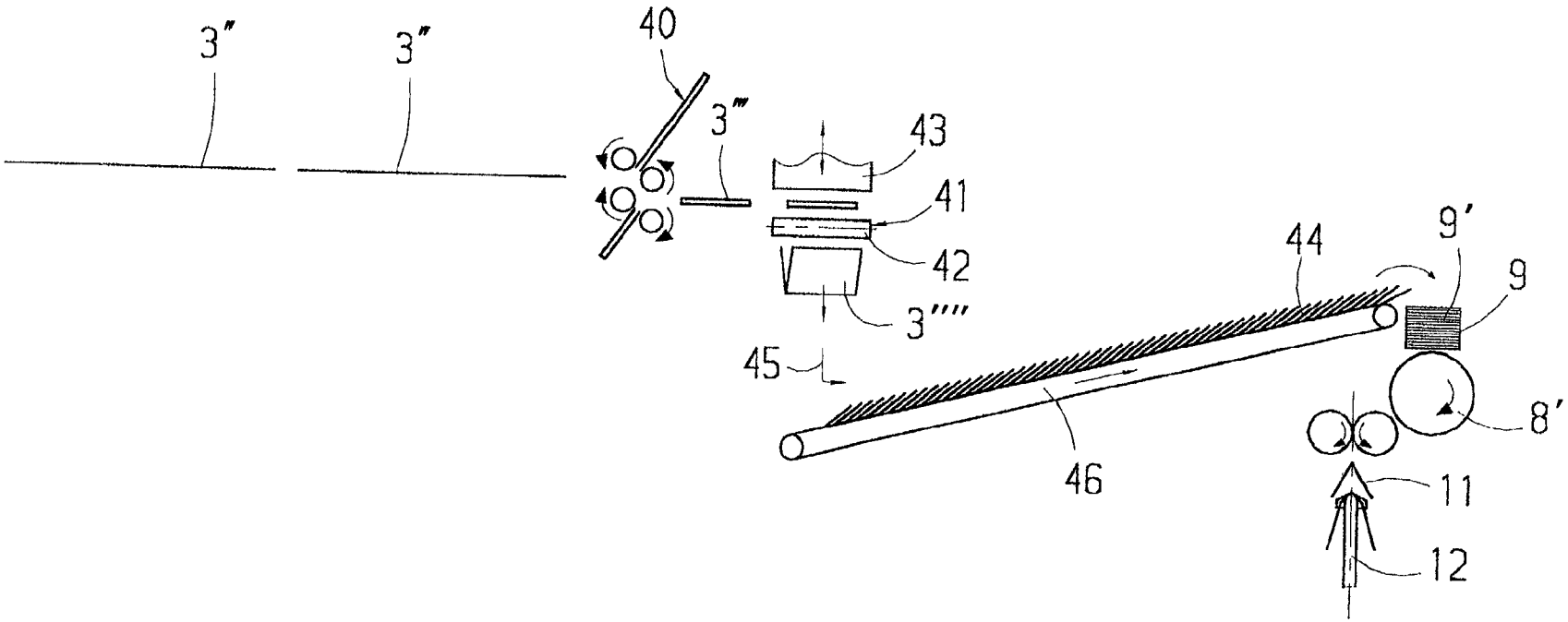
FIG. 9 is a further schematic view of the device according to the embodiment of FIG. 8.

In the arrangement according to FIGS. 8 and 9, an endless paper web is printed by means of the digital printing machine 22. This paper web 2" is cut by a cutting machine, not illustrated, in the transverse direction into web sections 3". These web sections 3" comprise several, for example, six, A4 formats or pages which are arranged in pairs adjacent to one another. The web sections 3" thus comprised of several pages are folded by a pocket folder or buckle folding machine 40 to a sheet 3''' and subsequently in the folding machine 41, i.e., a knife folding machine, to a sheet 3''''. After deflection according to arrow 45, they are then further transported in an imbricated flow 44 by means of transport belts 46 to a stacking device 9 in which a stack 91 is formed. This stack 9' provides a buffer and is individualized and opened by means of a sheet feeder 8. The open sheet sections are then collected, as described above, on the knife 11 and the complete collected brochure is then dropped onto the collecting chain 12. The folding device 41 is comprised in manner known in the art substantially of a folding knife 43 which moves the folded web sections 3''' between two oppositely rotating rollers 42.

Figure 10:
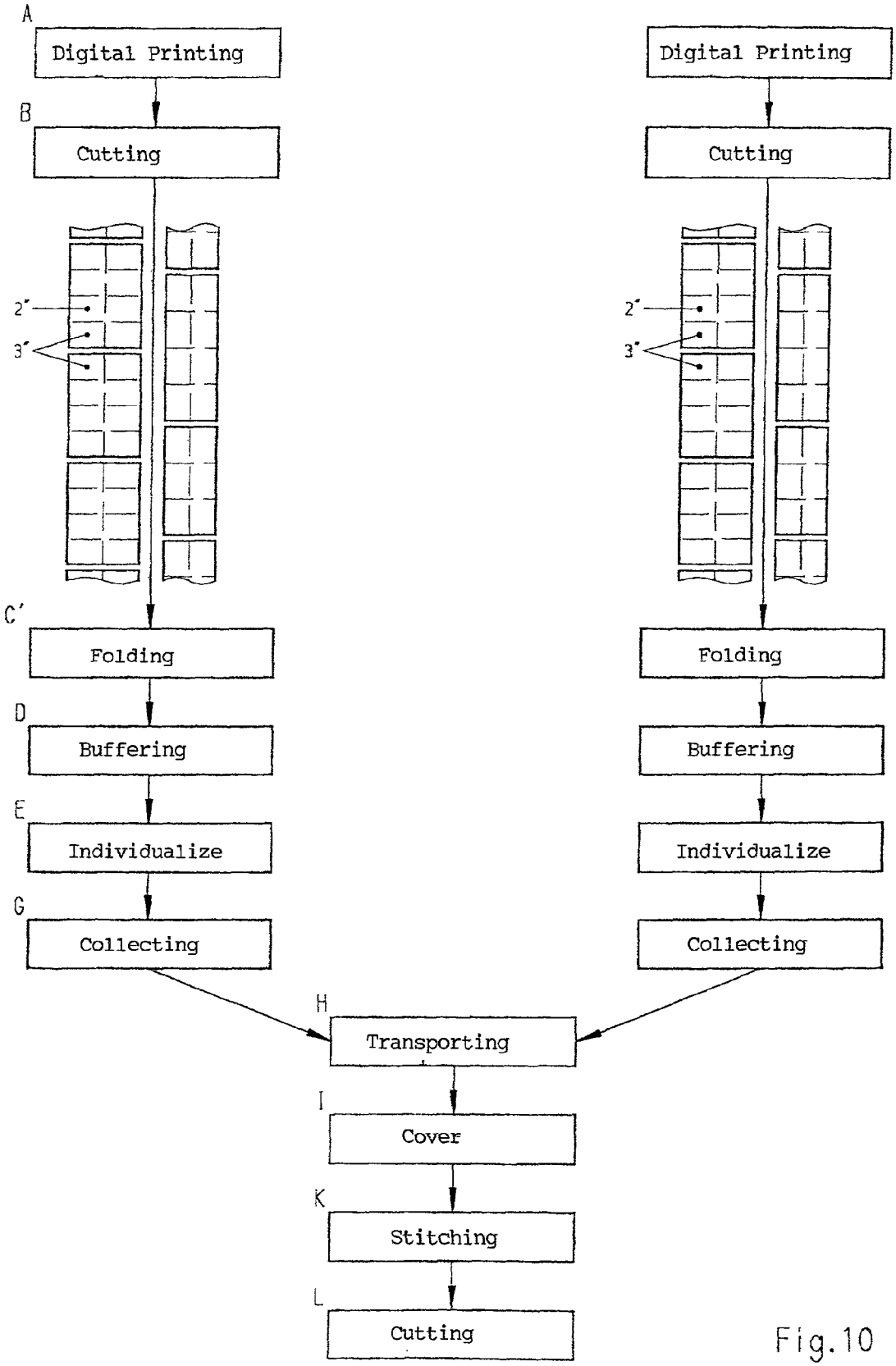
FIG. 10 shows a flow chart of a method according to the invention for using a device according to the embodiment of FIGS. 8 and 9.

FIG. 10 illustrates the method which can be performed by means of the device according to FIGS. 8 and 9. The method differs from that according to FIG. 7 substantially in that web sections 3" are cut and subsequently folded (C') which, in general, eliminates the need for distribution. However, such a distribution, is, in principle, possible also with this method. As illustrated in FIG. 10, by means of a further digital printing machine 22 a second paper web 2" can be printed in parallel, then cut, folded, buffered, individualized, and collected. After collection of the web sections, they are dropped onto a common collecting chain 12 and then transported to further processing steps. On the collecting chain 12 the brochures of two digital printing machines 22 are thus collected. These two digital printing machines 22 can print simultaneously. However, it is also conceivable that only one of these two digital printing machines 22 is used for printing. The use of two or more than two digital printing machines 22 is advantageous also for very thick brochures. A first digital printing machine 22 prints a first group of sheets which are opened and collected by means of a feeder 8. The second digital printing machine 22 prints a second group of sheets which are then combined with the first group on the collecting chain 12.

While specific embodiments of the invention have been shown and described in detail to illustrate the inventive principles, it will be understood that the invention may be embodied otherwise without departing from such principles.

What is claimed is:

1. A method for producing folded printed products, the method comprising the steps of:

a) sequentially printing a paper web by at least one digital printing machine, respectively;

b) processing the paper web by a sequence of processing steps comprising:

b1) forming full size sheets or web sections comprising at least four printed pages for a printed product with a multiple of four printed pages;

b2) folding the full size sheets or web sections to a folded state, respectively;

b3) collecting the full size sheets or web sections in the folded state; and b4) stitching the full size sheets or the web sections in the folded state;

c) forming a buffer of the full size sheets or the web sections during the sequence of processing steps b1) to b4) and individualizing the full size sheets or the web sections coming from the buffer to decouple the digital printing machine from at least some of the steps b1) to b4) of the sequence of processing steps, wherein the web sections sequentially arranged in the stack and forming a complete printed product, respectively, are individualized and then opened, wherein the full size sheets sequentially arranged in the stack and forming a complete printed product, respectively, are individualized and then folded, and wherein, in the step of collecting, the full size sheets or the web sections are placed onto a drop-controlled knife arranged above a collecting chain of a gatherer-stitcher.

2. The method according to claim 1, wherein, in the step of forming a buffer, the full size sheets are distributed to form at least two buffer arrangements.

3. The method according to claim 2, wherein the full size sheets are distributed by at least one switch.

4. The method according to claim 2, wherein the full size sheets are distributed to at least two planes arranged atop one another.

5. The method according to claim 1, wherein the step c) of forming a buffer is carried out after the web sections are folded according to step b2).

6. The method according to claim 5, wherein the web sections are folded in a pocket folder or buckle folding machine.

7. The method according to claim 6, wherein the web sections, subsequent to being folded in the pocket folder or buckle folding machine, are folded parallel to a processing direction of the web sections to a folded sheet having a gripping edge configured for opening.

8. The method according to claim 5, wherein the web sections are individualized by suction devices or rotating gripping devices of a feeder.

9. The method according to claim 5, wherein the web sections are fed in an imbricated flow after the step b2) and are retained to form a stack.

10. The method according to claim 9, wherein the web sections are individualized by being pulled off the stack.

11. The method according to claim 1, wherein in the step of forming a buffer at least one stack, at least one retaining stretch, or at least one coil is formed.

12. The method according to claim 11, wherein the full size sheets are fed in an imbricated flow and retained to form the stack.

13. The method according to claim 11, wherein the full size sheets are individualized by being pulled off the stack.

14. The method according to claim 1, wherein the full size sheets are individualized by suction devices or rotating gripping devices of a feeder.

15. The method according to claim 1, wherein a last one of the full size sheets of a complete printed product or a last one of the web sections of a complete printed product has a control mark readable by a read head for interrupting the step of individualizing.

16. The method according to claim 1, wherein a set of the full size sheets or a set of the web sections forming a complete printed product is collected on the knife, respectively.

17. The method according to claim 16, wherein, after completion of collection of a complete printed product on the knife, the step of individualizing is interrupted for several cycles and the collected full size sheets or the collected web sections are aligned on the knife and then dropped onto the collecting chain by withdrawing the knife.

18. The method according to claim 1, wherein at least two digital printing machines are used, wherein a first one of the digital printing machines prints a first group of the full size sheets and a second one of the digital printing machines prints a second group of the full size sheets and wherein the first and second groups are combined on the collecting chain of a gatherer-stitcher.

19. The method according to claim 1, wherein at least two digital printing machines are used, wherein a first one of the digital printing machines prints a first group of the web sections and a second one of the digital printing machines prints a second group of the web sections and wherein the first and second groups are combined on the collecting chain of a gatherer-stitcher to a printed product.

20. The method according to claim 1, wherein, after the step of stitching, three free sides of the full size sheets or the web sections are cut.

21. The method according to claim 1, wherein printed products having different contents are printed.

22. A device for producing printed products, the device comprising:

a digital printing machine configured to print at least one paper web;

a cutting machine configured to cut the paper web to several full size sheets or web sections;

a transport device configured to transport the full size sheets or the web sections;

one or more folding devices configured to fold the full size sheets or the web sections;

means for collecting the full size sheets or web sections in a folded state;

means for stitching the full size sheets or web sections collected on the means for collecting;

means for forming a buffer of the full size sheets or the web sections before individualizing the full size sheets or the web sections for being collected by the means of collecting.

23. The device according to claim 22, further comprising a distribution device configured to distribute the full size sheets onto at least two sheet flows.

24. The device according to claim 23, wherein the distribution device has a switch configured to distribute the full size sheets synchronously with a printing cycle of the digital printing machine.

25. The device according to claim 23, further comprising at least one transfer device configured to cascade the full size sheets to a slower-moving belt such that the full size sheets are transported on the slower-moving belt in an imbricated arrangement.

26. The device according to claim 23, wherein at least one feeder is provided and configured to receive the full size sheets and arrange the full size sheets as a stack forming the buffer.

27. The device according to claim 26, wherein the means of collecting comprises a knife correlated with the feeder, wherein the full size sheets or the web sections are collected on the knife in a folded state.

28. The device according to claim 27, wherein the means for stitching is a gatherer-stitcher comprising a collecting chain, wherein the knife is arranged above the collecting chain.

29. The device according to claim 28, wherein the folding device is a pocket folder or buckle folding machine configured to fold the web sections.

30. The device according to claim 28, wherein the folding device is a folding machine configured to fold the web sections to a sheet with a gripping edge.

* * * * *